United States Patent [19]

Hartmann et al.

[11] 4,172,166

[45] Oct. 23, 1979

[54] CARPET WITH NON-WOVEN BACKING

[75] Inventors: Ludwig Hartmann; Ivo Ruzek, both of Kaiserslautern, Fed. Rep. of Germany

[73] Assignee: Firma Carl Freudenberg, Weinheim, Fed. Rep. of Germany

[21] Appl. No.: 947,290

[22] Filed: Sep. 29, 1978

[30] Foreign Application Priority Data

Aug. 5, 1978 [DE] Fed. Rep. of Germany ..... 2834468

[51] Int. Cl.[2] ..... B32B 27/34

[52] U.S. Cl. ..... 428/95; 428/96; 428/288; 428/296

[58] Field of Search ..... 428/95, 96, 288, 296

[56] References Cited

U.S. PATENT DOCUMENTS 4,093,763 6/1978 Hartmann ..... 428/95

*Primary Examiner*—Marion E. McCamish

*Attorney, Agent, or Firm*—Sprung, Felfe, Horn, Lynch & Kramer

[57] ABSTRACT

In a carpet capable of being shaped three-dimensionally particularly for use in automobiles, comprising a tufted spun nonwoven fabric backing of polyester reinforced by a binding-fiber content and provided with at least a single-layer back coating of an at least partly thermoplastic material, and tufting through said base, the improvement which comprises constructing the spun nonwoven fabric so that at a temperature of 127° C. it has about 40 to 50%, and at a temperature of 157° C. about 25 to 35%, of its tensile strength at 22° C. and an elongation of about 65 to 100%, but at least a value of about 15 N per cm of width. Advantageously, the carpet includes a back coating of one layer of acrylic resin on the spun nonwoven fabric and a further layer of sintered polyethylene powder on top of the acrylic resin layer.

6 Claims, No Drawings

CARPET WITH NON-WOVEN BACKING

The invention relates to a carpet capable of being shaped three-dimensionally, in particular for automobiles, consisting of a tufted spun nonwoven fabric made of polyester and bonded by a binding-fiber content, and having an at least single-layer back coating of an at least partly thermoplastic material.

From German Pat. No. 22 40 437, a process for the manufacture of high-strength, dimensionally stable spun nonwoven fabrics is known which are used particularly in the manufacture of tufted carpets. The latter have excellent wearing properties so long as they are formed two-dimensionally. When they are given a three-dimensional shape, however, as is essential in the manufacture of automobile carpets, for example, they exhibit a thinning out of the pile density particularly over stretched areas, which is undesirable with regard to both appearance and wearing properties. This is due to an unsatisfactory behavior of the backing material during shaping.

The invention has as its object to provide a carpet which has particularly good shaping capability while avoiding said drawbacks.

This object is accomplished in a carpet base of the type outlined above in that the spun nonwoven fabric is constructed so that at a temperature of 127° C. it has about 40 to 50%, and at a temperature of 157° C. about 25 to 35%, of its tensile strength at 22° C. and an elongation of about 65 to 100%, but not less than about 15 N per cm of width.

In a special variant, it is contemplated that the tensile strain on the spun nonwoven fabric measured at an elongation of 10% and at 127° C. be about 50 to 60%, and at 157° about 30 to 40%, of the tensile strain at 22° C. and an elongation of 10%. In another advantageous variant it is contemplated that the back layer be a layer of acrylic resin. In still another advantageous variant, an additional layer of a sintered polyethylene powder is provided.

The basic process for the manufacture of the backing material for the carpet in accordance with the invention may correspond to that according to German Pat. No. 22 40 437, and a person skilled in the art will have no difficulty in adjusting the parameters essential to the invention. Nevertheless, to the average person skilled in the art the result obtained in accordance with the invention is a totally unexpected one.

Tufted carpets for lining the foot space of motor vehicles are subject in large measure to special taste requirements and also to technical variations which manifest themselves particularly in a constantly changing pile density. The latter is dependent particularly on the spacing of the tufts inserted in the nonwoven backing. These tufts are inserted with needles and, depending on the spacing of the punctures, marked changes result with regard to the physical properties of the tufted material. This is why such carpet materials have up to now had markedly varying shaping properties, depending on the pile density, even when perfectly identical backing materials were used.

This drawback is largely overcome in the carpet base in accordance with the invention when a backing material is used which has said parameters.

PRACTICAL EXAMPLE

For the manufacture of a spun nonwoven fabric, a spinning installation is used which consists of a plurality of spinning positions as described in German Pat. No. 2,240,437. Every spinning position has two spinnerets (A and B) of elongated form with spinning orifices disposed in parallel rows. The individual spinning positions of the spinning installation are spaced 400 mm from one another, the elongated spinnerets throughout the installation being disposed parallel and obliquely over a receiving belt, in a manner similar to the oblique-angle arrangement shown in published German patent application DOS No. 1,560,790.

Spinneret A serves to spin system filaments and has 64 orifices with a capillary diameter of 0.3 mm and a capillary length of 0.75 mm. The orifices are arranged in two staggered rows over a length of 280 mm.

Spinneret B serves to spin binding filaments and has 32 orifices with the same capillary diameter as spinneret A, evenly distributed in one row over the length of 280 mm.

All spinnerets A of the spinning installation are combined into the spinning system A and supplied with polyester melt from a spinning extruder, every spinneret being provided with a spinning pump.

Similarly, all spinnerets B are combined into the spinning system B and supplied with copolyester from a spinning extruder. The filaments formed by the two spinnerets of every spinning position are blown with air below the spinneret over a distance of 150 mm transverse to the direction of filament travel and then combined to form an elongated row of filaments in which the two filament components are uniformly mingled, conveyed through the cooling shaft, and routed to an aerodynamic drawing-off means.

The aerodynamic drawing-off means is a drawing-off channel of elongated form with a length of 300 mm and a width of 6 mm. Said drawing-off channel is provided on both longitudinal sides with a compressed-air drawing-off slot which extends over the entire length of 300 mm and is connected to a compressed-air chamber. By adjustment of the air pressure, the air velocity is varied in the channel section and thus the filament-withdrawal conditions are controlled.

The filament rows exiting from the lower air-channel discharge openings and consisting of well-mingled, parallel-running polyester and copolyester filaments are then subjected by means of a swinging device to a periodic oscillatory motion and routed to an endless metallic screen belt moving in a direction transverse to the direction of oscillation. The impingement of the filament rows on the screen belt causes a tangled web to be formed. The propelling air with which the filaments are drawn off is removed below the screen belt.

Directly behind the return roller of the endless screen belt, which is disposed in the direction of travel, a calender is arranged whose working parts are two differently heated rolls. The function of this calender is to prebond the nonwoven fabric with differential bond strength over its thickness. For this purpose the upper calender roll is heated to a lower temperature than the lower one.

The prebonded nonwoven fabric is then sprayed on one side with an aqueous emulsion of dimethyl polysiloxane and hydroxymethyl polysiloxane, the two components being polymerizable at elevated temperature, so that essentially only the upper side of the nonwoven fabric, which is more lightly prebonded and is more open, is wetted with the emulsion. The nonwoven fabric so prebonded and sprayed is then passed to the actual bonding apparatus. Said apparatus consists of a perforated drum with a revolving endless belt. The nonwoven fabric is introduced into the gap between the perforated drum and the revolving screen belt and thus held over the surface during solidification and pressed against the drum, with the soft side wetted with the after-treatment facing the drum. Hot air is passed through the nonwoven fabric from the screen side so that there is a temperature gradient through the thickness of the nonwoven fabric.

The spinning conditions are presented in the table which follows:

Table 1

| | Spinning system A | Spinning System B |
|---|---|---|
| | Polyethylene terephthalate | Polyethylene-terephthalate coadipate |
| Relative viscosity in o-dichlorobenzene (2 parts by weight) and phenol (3 parts by weight) | 1.36 | 1.40 |
| Melt temperature (°C.) | 290 | 270 |
| Discharge rate per spinneret (kg/min) | 0.385 | 0.100 |
| Filament velocity (m/min) | | |
| $v_o$ at discharge from orifice | 70 | 37 |
| $v_s$ in the draw-off channel | 5000 | 4800 |
| Air velocity in the drawing-off channel (m/min) | 13000 | 13000 |
| Filament values: | | |
| Titer (dtex) | 12 | 6.5 |
| Strength (ponds/dtex) | 3.4 | 3.1 |
| Elongation (%) | 90 | 110 |
| Shrinkage in boiling water (%) | 4 | 15 |

Before spinning, the polyethylene terephthalate had a relative viscosity of 1.38, measured as an 0.5% solution in a mixture of o-dichlorobenzene (2 parts by weight) and phenol (3 parts by weight). The copolyester is a polyethyleneterephthalate coadipate with 25% adipic acid and a relative viscosity of 1.42. The crystalline melting point is 200° C.

The weight per unit area of the tangled nonwoven web is set during manufacture for 120 g/m$^2$. The upper roll of the bonding calender is heated to a temperature of 95° C., the lower roll to 115° F. The linear pressure is 50 kp/cm of width.

The application of the aftertreatment is controlled by means of the spray device in such a way that 0.10 g of a hydroxymethyl polysiloxane and 0.15 g of dimethyl polysiloxane per m$^2$ are applied to the top side.

The hot-air temperature in the bonding apparatus is set for 205° C., the nonwoven fabric being exposed to the air stream for 60 sec at the rate of 1.9 cbm/m$^2$/sec screen surface.

The spun nonwoven fabric was then tufted with a polyamide spun yarn on a tufting loom at a cutpile setting. The tufting machine had 31.5 needles per 10 cm (⅛" gauge), and the number of pile loops was 30 per 10 cm. The carpet was dyed, dried and then coated on the back, first with an acrylate dispersion binder. After curing, a further layer of polyethylene powder was applied to the back coating and sintered.

Table 2

| Designation | Tuft backing | Raw carpet | | Coated carpet | |
|---|---|---|---|---|---|
| Test temperature | Room temperature (22° C.) | | | 137° C. | 157° C. |
| Weight per unit area (g/m$^2$) | 120 | 770 | 1270 | 1270 | 1270 |
| Maximum tractive force (N) | | | | | |
| Lengthwise | 220 | 226 | 390 | 190 | 135 |
| Crosswise | 210 | 186 | 331 | 13 | 97 |
| Maximum tractive elongation (%) | | | | | |
| Lengthwise | 35 | 42 | 42 | 82 | 92 |
| Crosswise | 38 | 40 | 42 | 76 | 73 |
| Strain at 10% elongation (N) | | | | | |
| Lengthwise | 150 | 90 | 270 | 150 | 102 |
| Crosswise | 150 | 70 | 150 | 78 | 52 |

If one wishes to modify the properties of the spun nonwoven fabric it can be accomplished in various known ways which do not, per se, constitute the present invention. For example, changing the copolymer system or its relative proportion will have an effect. The temperatures and treatment speed on the calender rolls will also result in modifying the amount of bonding which will affect the fabric properties. The melt temperatures and the filament velocities at the orifices and in the draw-off channels will affect filament properties in known manner which in turn will affect fabric properties.

It will be appreciated that the instant specification and claims are set forth by way of illustration and not limitation, and that various modifications and changes may be made without departing from the spirit and scope of the present invention.

We claim:

1. In a carpet capable of being shaped three-dimensionally particularly for use in automobiles, comprising a tufted spun nonwoven fabric backing of polyester reinforced by a binding-fiber content and provided with at least a single-layer back coating of an at least partly thermoplastic material, and a tufting through said base, the improvement which comprises constructing the spun nonwoven fabric so that at a temperature of 127° C. it has about 40 to 50%, and at a temperature of 157° C. about 25 to 35%, of its tensile strength at 22° C. and an elongation of about 65 to 100%, but at least a value of about 15 N per cm of width.

2. A carpet according to claim 1, wherein the tensile strain of the spun nonwoven fabric measurable when an elongation of 10% is reached at 127° C. is about 50 to 60% and at 157° C. is about 30 to 40% of the tensile strain which is measurable at an elongation of 10% at 22° C.

3. A carpet according to claim 2, including a back coating of one layer of acrylic resin on the spun nonwoven fabric and a further layer of sintered polyethylene powder on the top of the acrylic resin layer.

4. A carpet according to claim 1, including a back coating of one layer of acrylic resin on the spun nonwoven fabric.

5. A carpet according to claim 4, including a further layer of sintered polyethylene powder on top of the acrylic resin layer.

6. A spun nonwoven fabric, especially suited for use as a backing to be tufted into carpet, which at a temperature of 127° C. has about 40 to 50%, and at a temperature of 157° C. about 25 to 35%, of its tensile strength at 22° C. and an elongation of about 65 to 100%, but at least a value of about 15 N per cm of width.

* * * * *